US011191998B2

(12) United States Patent
Suk et al.

(10) Patent No.: US 11,191,998 B2
(45) Date of Patent: Dec. 7, 2021

(54) METHOD, SYSTEM AND NON-TRANSITORY COMPUTER-READABLE RECORDING MEDIUM FOR MEASURING BALL SPIN

(71) Applicant: CREATZ., INC., Suwon-si (KR)

(72) Inventors: Yong Ho Suk, Gyeonggi-do (KR); Jey Ho Suk, Seoul (KR)

(73) Assignee: CREATZ., INC., Suwon-si (KR)

( * ) Notice: Subject to any disclaimer, the term of this patent is extended or adjusted under 35 U.S.C. 154(b) by 0 days.

(21) Appl. No.: 16/666,636

(22) Filed: Oct. 29, 2019

(65) Prior Publication Data

US 2020/0129810 A1 Apr. 30, 2020

(30) Foreign Application Priority Data

Oct. 29, 2018 (KR) ..... 10-2018-0130255

(51) Int. Cl.
*A63B 69/36* (2006.01)
*A63B 24/00* (2006.01)
(Continued)

(52) U.S. Cl.
CPC ..... *A63B 24/0021* (2013.01); *A63B 43/008* (2013.01); *A63B 37/0022* (2013.01);
(Continued)

(58) Field of Classification Search
CPC ..... A63B 37/0022; A63B 71/0622; A63B 2071/0638; A63B 2220/05; A63B 69/3623; A63B 69/3658; A63B 69/3661; A63B 69/3694; A63B 2071/0694; A63B 2220/16; A63B 2220/30; A63B 2220/35; A63B 24/0021; A63B 43/008; A63B 24/0006;
(Continued)

(56) References Cited

U.S. PATENT DOCUMENTS 5,471,383 A * 11/1995 Gobush ..... A63B 69/0026 700/91
6,458,035 B1 * 10/2002 Katayama ..... A63B 24/0021 473/152
(Continued)

FOREIGN PATENT DOCUMENTS

CN 105999677 A 10/2016
JP 2003117044 A 4/2003
(Continued)

*Primary Examiner* — Lawrence S Galka
(74) *Attorney, Agent, or Firm* — Dinsmore & Shohl LLP; Yongsok Choi, Esq.

(57) ABSTRACT

According to one aspect of the invention, there is provided a method for measuring ball spin, the method comprising the steps of: detecting information on a mark appearing in a region corresponding to a ball hit by a user in each of a plurality of images in which the ball is photographed; determining whether it is possible to directly calculate physical quantities related to spin of the ball on the basis of the information on the mark; and when it is determined that it is not possible to directly calculate the physical quantities related to spin of the ball on the basis of the information on the mark, estimating the physical quantities related to spin of the ball on the basis of physical quantities related to at least one of a speed and an angle of the ball or a club hitting the ball.

7 Claims, 2 Drawing Sheets

(51) Int. Cl.
*A63B 43/00* (2006.01)
*A63B 37/00* (2006.01)
*A63B 71/06* (2006.01)

(52) U.S. Cl.
CPC ... *A63B 71/0622* (2013.01); *A63B 2024/0034* (2013.01); *A63B 2071/0638* (2013.01); *A63B 2071/0694* (2013.01); *A63B 2220/05* (2013.01); *A63B 2220/35* (2013.01); *A63B 2220/807* (2013.01)

(58) Field of Classification Search
CPC ..... A63B 67/02; A63B 2024/0031; A63B 2024/0034; G06T 7/20; G06T 7/246; G06T 7/248; G06T 7/60; G06T 2207/10016; G06T 2207/30168; G06T 2207/30204; G06T 2207/30224; G06T 2207/30241; A63F 13/20; A63F 13/80; G01C 11/02; G01C 2011/36
See application file for complete search history.

(56) References Cited

U.S. PATENT DOCUMENTS 6,821,211 B2 * 11/2004 Otten ..... A63B 69/3614 473/219
7,086,954 B2 * 8/2006 Gobush ..... G01P 3/40 473/198
2013/0316839 A1 * 11/2013 Woo ..... A63F 13/06 473/156
2014/0003666 A1 * 1/2014 Park ..... G06K 9/3241 382/103
2014/0004969 A1 * 1/2014 Jang ..... G09B 19/0038 473/156
2015/0350609 A1 * 12/2015 Kim ..... G06T 7/246 348/47
2015/0381886 A1 * 12/2015 Kato ..... H04N 5/23245 348/207.1
2016/0175648 A1 6/2016 Kenya
2017/0200277 A1 * 7/2017 Keat ..... G06T 7/248
2017/0254892 A1 * 9/2017 Tuxen ..... G01S 13/58
2018/0005396 A1 * 1/2018 Suk ..... G06T 7/246
2018/0221746 A1 * 8/2018 Joo ..... A63B 69/3658
2018/0353828 A1 * 12/2018 Otten ..... G06T 7/248

FOREIGN PATENT DOCUMENTS

KR 101059325 B1 8/2011
KR 101412505 B1 6/2014
KR 20150084816 A 7/2015
KR 20180002408 A 1/2018
KR 101826837 B1 2/2018
KR 101887428 B1 9/2018

* cited by examiner

METHOD, SYSTEM AND NON-TRANSITORY COMPUTER-READABLE RECORDING MEDIUM FOR MEASURING BALL SPIN

CROSS-REFERENCE TO RELATED APPLICATION(S)

This application claims priority to Korean Patent Application No. 10-2018-0130255 filed on Oct. 29, 2018, the entire contents of which are hereby incorporated by reference.

FIELD OF THE INVENTION

The present invention relates to a method, system, and non-transitory computer-readable recording medium for measuring ball spin.

BACKGROUND

Virtual golf systems are widely spreading which allow golfers to virtually play golf at low cost in downtown areas and the like. The basic concept of such virtual golf systems is to acquire a number of photographed images of a golf ball upon being hit by a golfer, measure physical quantities of the golf ball on the basis of the trajectory, interval, size, and the like thereof, perform a simulation of the shot, and display a result of the simulation on a screen. In the virtual golf systems, it is of paramount importance to provide an accurate simulation result on the basis of physical quantities related to spin of a ball hit by a golfer.

As one example of related conventional techniques, a system has been introduced in which a plurality of images each including a golf ball are acquired and physical quantities related to spin of the golf ball are calculated on the basis of a mark printed on the golf ball.

However, the techniques introduced so far as well as the above-described conventional technique have no interest in making corrections or proposing alternatives for the cases in which calculation of physical quantities related to spin of a golf ball becomes difficult or an error occurs in recognizing a mark on the golf ball due to a problem such as the mark being erased.

In this connection, the inventor(s) present a novel and inventive technique that can compensate for the foregoing on the basis of physical quantities of at least one of a speed and an angle of a golf ball or a golf club hitting the golf ball.

SUMMARY OF THE INVENTION

One object of the present invention is to solve all the above-described problems in the prior art.

Another object of the invention is to estimate a trajectory of a ball more accurately, by estimating or correcting physical quantities related to spin of the ball on the basis of physical quantities related to at least one of a speed and an angle of the ball or a club hitting the ball.

Yet another object of the invention is to correct an error that may occur when estimating physical quantities related to spin of a ball on the basis of a mark printed on the ball.

The representative configurations of the invention to achieve the above objects are described below.

According to one aspect of the invention, there is provided a method for measuring ball spin, the method comprising the steps of: detecting information on a mark appearing in a region corresponding to a ball hit by a user in each of a plurality of images in which the ball is photographed;

determining whether it is possible to directly calculate physical quantities related to spin of the ball on the basis of the information on the mark; and when it is determined that it is not possible to directly calculate the physical quantities related to spin of the ball on the basis of the information on the mark, estimating the physical quantities related to spin of the ball on the basis of physical quantities related to at least one of a speed and an angle of the ball or a club hitting the ball.

According to another aspect of the invention, there is provided a system for measuring ball spin, the system comprising: a mark information acquisition unit configured to acquire information on a mark appearing in a region corresponding to a ball hit by a user in each of a plurality of images in which the ball is photographed; and a physical quantity information provision unit configured to determine whether it is possible to directly calculate physical quantities related to spin of the ball on the basis of the information on the mark, and to, when it is determined that it is not possible to directly calculate the physical quantities related to spin of the ball on the basis of the information on the mark, estimate the physical quantities related to spin of the ball on the basis of physical quantities related to at least one of a speed and an angle of the ball or a club hitting the ball.

In addition, there are further provided other methods and systems to implement the invention, as well as non-transitory computer-readable recording media having stored thereon computer programs for executing the methods.

According to the invention, it is possible to estimate a trajectory of a ball more accurately, by estimating or correcting physical quantities related to spin of the ball on the basis of physical quantities related to at least one of a speed and an angle of the ball or a club hitting the ball.

According to the invention, it is possible to correct an error that may occur when estimating physical quantities related to spin of a ball on the basis of a mark printed on the ball.

DETAILED DESCRIPTION

Figure 1:
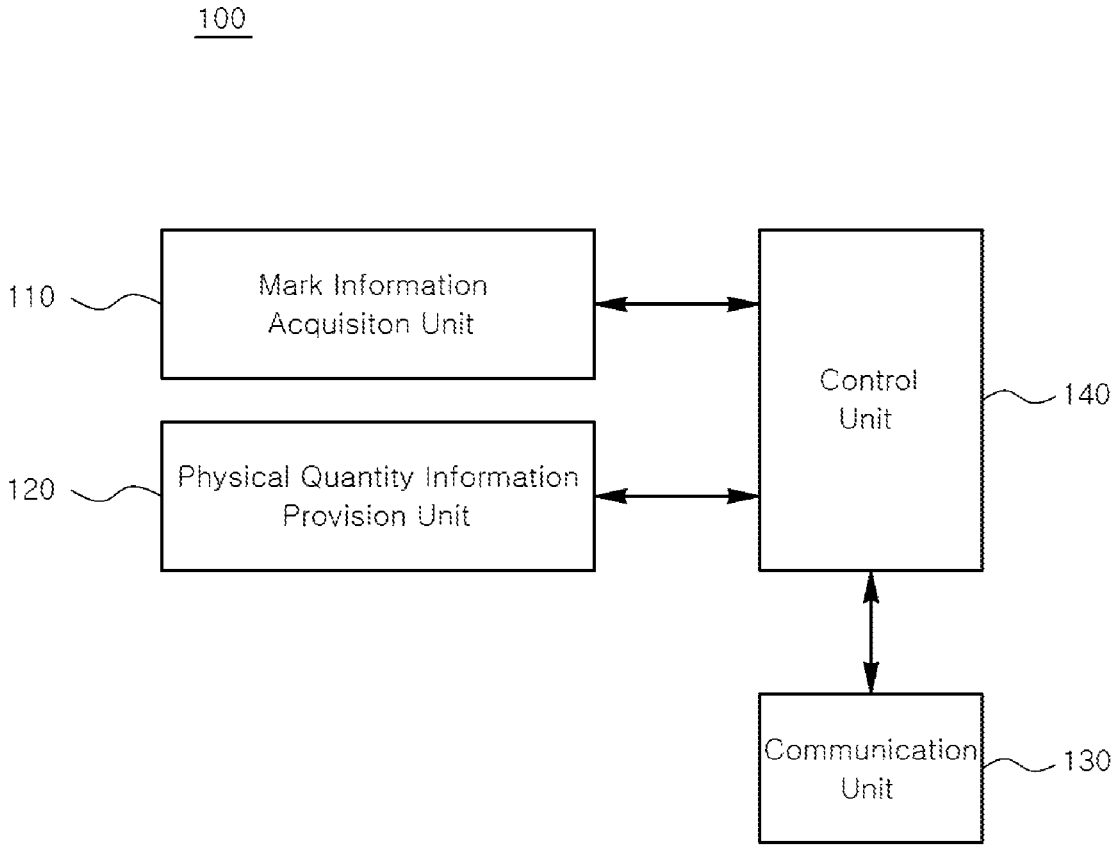
FIG. 1 illustratively shows the internal configuration of a measurement system for measuring ball spin according to one embodiment of the invention.

In the following detailed description of the present invention, references are made to the accompanying drawings that show, by way of illustration, specific embodiments in which the invention may be practiced. These embodiments are described in sufficient detail to enable those skilled in the art to practice the invention. It is to be understood that the various embodiments of the invention, although different from each other, are not necessarily mutually exclusive. For example, specific shapes, structures and characteristics described herein may be implemented as modified from one embodiment to another without departing from the spirit and scope of the invention. Furthermore, it shall be understood that the positions or arrangements of individual elements within each embodiment may also be modified without departing from the spirit and scope of the invention. Therefore, the following detailed description is not to be taken in a limiting sense, and the scope of the invention is to be taken as encompassing the scope of the appended claims and all equivalents thereof. In the drawings, like reference numerals refer to the same or similar elements throughout the several views.

Hereinafter, various preferred embodiments of the present invention will be described in detail with reference to the accompanying drawings to enable those skilled in the art to easily implement the invention.

Configuration of a Measurement System

FIG. 1 illustratively shows the internal configuration of a measurement system 100 for measuring ball spin according to one embodiment of the invention.

Referring to FIG. 1, the measurement system 100 according to one embodiment of the invention may comprise a mark information acquisition unit 110, a physical quantity information provision unit 120, a communication unit 130, and a control unit 140. According to one embodiment of the invention, at least some of the mark information acquisition unit 110, the physical quantity information provision unit 120, the communication unit 130, and the control unit 140 may be program modules that communicate with an external system (not shown). The program modules may be included in the measurement system 100 in the form of operating systems, application program modules, and other program modules, while they may be physically stored in a variety of commonly known storage devices. Further, the program modules may also be stored in a remote storage device that may communicate with the measurement system 100. Meanwhile, such program modules may include, but not limited to, routines, subroutines, programs, objects, components, and data structures for performing specific tasks or executing specific abstract data types according to the invention as will be described below.

Meanwhile, although the measurement system 100 has been described as above, the above description is illustrative, and it will be apparent to those skilled in the art that at least a part of the functions or components of the measurement system 100 may be implemented or included in a known virtual golf simulation system, as necessary. Further, in some cases, all the functions and components of the measurement system 100 may be implemented or included in a known virtual golf simulation system.

First, the mark information acquisition unit 110 according to one embodiment of the invention may function to acquire information on a mark appearing in a region corresponding to a ball hit by a user in each of a plurality of images in which the ball is photographed. According to one embodiment of the invention, a mark for measuring physical quantities of the ball hit by the user may be printed on the surface of the ball.

Specifically, the mark information acquisition unit 110 according to one embodiment of the invention may specify a region corresponding to a ball hit by a user in each of a plurality of images in which the ball is photographed, and may acquire information on a number, position, size, direction, and shape of at least one mark appearing in the specified region.

Meanwhile, when the plurality of images in which the ball is photographed are acquired, the mark information acquisition unit 110 according to one embodiment of the invention may also perform image corrections for brightness, contrast, sharpness, and the like of the plurality of acquired images.

For example, the mark information acquisition unit 110 according to one embodiment of the invention may calculate a photographed brightness distribution of a region corresponding to the ball in each of the plurality of images in which the ball is photographed, using a stochastic or statistical model such as a linear regression model and a non-parametric model, and may correct the photographed brightness distribution of the region corresponding to the ball in at least one of the plurality of images, with reference to a predetermined reference brightness distribution (i.e., a brightness distribution predetermined to be suitable for detecting and recognizing a mark printed on the surface of the ball). That is, the above correction may reduce the possibility of errors due to brightness, contrast, sharpness, and the like in acquiring information on a mark commonly appearing over the plurality of images, thereby increasing the accuracy of detecting and recognizing the mark.

Next, the physical quantity information provision unit 120 according to one embodiment of the invention may function to determine whether it is possible to directly calculate physical quantities related to spin of the ball on the basis of the information on the mark.

For example, when the plurality of images acquired by the mark information acquisition unit 110 include less than a predetermined number of images in which the mark is detected or recognized, the physical quantity information provision unit 120 according to one embodiment of the invention may determine that it is not possible to directly calculate the physical quantities related to spin of the ball (e.g., a spin rate and a spin direction of the ball).

As another example, when it is determined that a mark or pattern for measuring the physical quantities related to spin of the ball from the information on the mark is not specified or not normal, the physical quantity information provision unit 120 according to one embodiment of the invention may determine that it is not possible to directly calculate the physical quantities related to spin of the ball. According to one embodiment of the invention, such a pattern may be specified on the basis of at least one of positions, sizes, directions, and shapes of two or more marks.

More specifically, it may be assumed that the physical quantities related to spin of the ball are calculated on the basis of a mark sequence, which is a time-sequential set of marks appearing over the plurality of images. (For example, a method disclosed in Korean Laid-Open Patent Publication No. 2018-2408 may be employed.) In this case, there may exist marks whose locations, directions, sizes, and shapes are similar at or above a predetermined level (i.e., marks matched to each other) between marks detected in a first image of the plurality of images according to one embodiment of the invention and marks detected in a second image temporally adjacent to the first image. A mark sequence including information on the locations, directions, sizes, and shapes of the matched marks in the first and second images may be specified, and the physical quantities related to spin of the ball may be calculated on the basis of the specified mark sequence. Further, in this case, a pattern consisting of two or more marks may be detected in both the first and second images temporally adjacent to each other. A pattern sequence including information on a location, direction, size, and shape of the pattern in each of the first and second images, and the physical quantities related to spin of the ball may be calculated on the basis of the specified pattern sequence.

According to one embodiment of the invention, when such a mark or pattern is not detected or a mark or pattern matched to a predetermined mark or pattern does not appear in consecutively photographed images for a predetermined period of time, the physical quantity information provision unit 120 may determine that a mark or pattern required for measuring the physical quantities related to spin of the ball from the information on the mark is not specified or not normal, and may consequently determine that it is not possible to directly calculate the physical quantities related to spin of the ball.

Further, when it is determined that it is not possible to directly calculate the physical quantities related to spin of the ball on the basis of the information on the mark, the physical quantity information provision unit 120 according to one embodiment of the invention may function to estimate the physical quantities related to spin of the ball on the basis of physical quantities related to at least one of a speed and an angle of the ball or a club hitting the ball.

Specifically, the physical quantity information provision unit 120 according to one embodiment of the invention may function to estimate the physical quantities related to spin of the ball with reference to a relationship between physical quantities related to at least one of speeds of a plurality of different balls, angles of the plurality of different balls, a speed of a club hitting the plurality of different balls, and an angle of the club hitting the plurality of different balls, and physical quantities related to spin of the plurality of different balls.

For example, the physical quantity information provision unit 120 according to one embodiment of the invention may define a relational expression on the basis of a relationship between physical quantities related to at least one of speeds of a plurality of different balls, angles of the plurality of different balls, a speed of a club hitting the plurality of different balls, and an angle of the club hitting the plurality of different balls, and physical quantities related to spin of the plurality of different balls, and may estimate the physical quantities related to spin of the ball corresponding to the physical quantities related to at least one of a speed and an angle of the ball or the club hitting the ball, on the basis of the defined relational expression.

As another example, the physical quantity information provision unit 120 according to one embodiment of the invention may estimate the physical quantities related to spin of the ball corresponding to the physical quantities related to at least one of a speed and an angle of the ball or the club hitting the ball, with reference to a lookup table or database for a matching relationship between physical quantities related to at least one of speeds of a plurality of different balls, angles of the plurality of different balls, a speed of a club hitting the plurality of different balls, and an angle of the club hitting the plurality of different balls, and physical quantities related to spin of the plurality of different balls.

Meanwhile, even when it is determined that it is possible to calculate the physical quantities related to spin of the ball on the basis of the information on the mark, the physical quantity information provision unit 120 according to one embodiment of the invention may determine the physical quantities related to spin of the ball by using a first physical quantity related to spin of the ball, which is estimated on the basis of the physical quantities related to at least one of a speed and an angle of the ball or the club hitting the ball, to correct a second physical quantity related to spin of the ball, which is calculated on the basis of the information on the mark.

For example, the physical quantity information provision unit 120 according to one embodiment of the invention may calculate a second physical quantity related to spin of the ball (e.g., a spin rate and a spin direction of the ball) by analyzing a mark sequence, which is a time-sequential set of marks appearing over the plurality of images, on the basis of the information on the mark, and may estimate a first physical quantity related to spin of the ball on the basis of the physical quantities related to at least one of a speed and an angle of the ball or the club hitting the ball. When the difference between the first and second physical quantities is not less than a first level (which may be predetermined), the physical quantity information provision unit 120 according to one embodiment of the invention may use the first physical quantity to correct the second physical quantity. Further, when the difference between the first and second physical quantities is not less than a second level (which may be predetermined) higher than the first level, the physical quantity information provision unit 120 according to one embodiment of the invention may determine the physical quantities related to spin of the ball from the first physical quantity rather than the second physical quantity.

Meanwhile, when the physical quantities related to spin of the ball are estimated, the physical quantity information provision unit 120 according to one embodiment of the invention may update a relationship between the physical quantities related to at least one of a speed and an angle of the ball or the club hitting the ball and the physical quantities related to spin of the ball, on the basis of the estimated physical quantities.

For example, the physical quantity information provision unit 120 according to one embodiment of the invention may estimate the physical quantities related to spin of the ball more accurately by using the first physical quantity to correct the second physical quantity, and then may update in real time a relational expression, database, lookup table, or the like for a relationship between the physical quantities related to at least one of a speed and an angle of the ball or the club hitting the ball and the physical quantities related to spin of the ball, on the basis of the estimated physical quantities.

Next, according to one embodiment of the invention, the communication unit 130 may function to enable data transmission/reception from/to the mark information acquisition unit 110 and the physical quantity information provision unit 120.

Lastly, according to one embodiment of the invention, the control unit 140 may function to control data flow among the mark information acquisition unit 110, the physical quantity information provision unit 120, and the communication unit 130. That is, the control unit 140 according to the invention may control data flow into/out of the measurement system 100 or data flow among the respective components of the measurement system 100, such that the mark information acquisition unit 110, the physical quantity information provision unit 120, and the communication unit 130 may carry out their particular functions, respectively.

Figure 2:
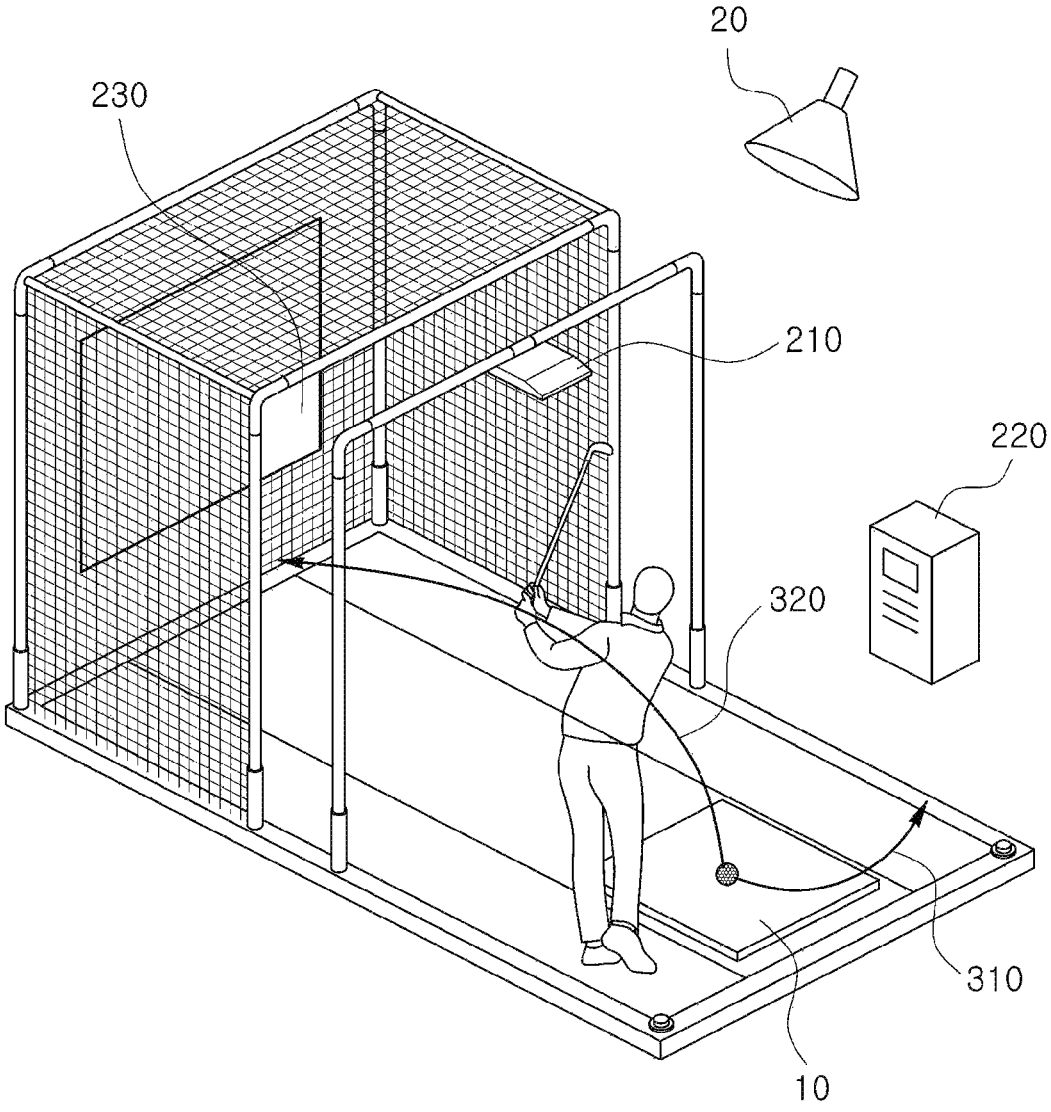
FIG. 2 illustratively shows a situation in which a measurement system according to one embodiment of the invention is utilized in a virtual golf simulation system according to one embodiment of the invention.

FIG. 2 illustratively shows a situation in which the measurement system 100 according to one embodiment of the invention is utilized in a virtual golf simulation system 200 according to one embodiment of the invention.

As shown in FIG. 2, the virtual golf simulation system 200 may comprise a shot unit 10, an illumination device 20, a photographing device 210, a simulator 220, and a display device 230. Further, the simulator 220 according to one embodiment of the invention may include the measurement system 100 according to the invention.

First, the shot unit 10 according to one embodiment of the invention may be a part on which a golfer steps up to place and hit a golf ball when using the virtual golf simulation system. The shot unit 10 may include a known swing plate, the tilt angle of which may be adjusted. It is noted that when the invention is applied to other kinds of virtual sport systems, those skilled in the art may modify the configuration of the shot unit 10 (and the configurations of other components associated therewith, if necessary) to suit to the characteristics of the corresponding sports.

Next, the illumination device 20 according to one embodiment of the invention may irradiate light artificially when the golfer plays virtual golf indoors or outdoors. As necessary, the illumination device 20 may be turned on and off, or the brightness thereof may be adjusted. Preferably, the illumination device 20 may be an infrared illumination device for preventing natural deterioration of golf ball images caused by the flickering of the light.

Next, the photographing device 210 according to one embodiment of the invention may include at least one camera (e.g., a high-speed camera) (not shown) and function to acquire two or more images of the golf ball (e.g., images of the moving golf ball). The photographing device 210 may be disposed in a location to look down at the moving golf ball as shown in FIG. 2, while it may be disposed in other locations.

Meanwhile, according to one embodiment of the invention, an image of the golf ball may be considered to be better if a mark printed on the surface of the golf ball is clearly shown such that a shape or position of the mark may be better specified. For example, if a mark shown in a region corresponding to the ball in the image of the golf ball is clearer, the simulator 220 to be described below may more accurately identify a mark sequence, which is a time-sequential set of marks appearing over the plurality of golf ball images, and more accurately calculate a spin rate and a spin direction of the golf ball.

Next, the simulator 220 according to one embodiment of the invention may function to acquire information on at least one mark appearing in a region corresponding to a ball hit by a user in each of a plurality of images in which the ball is photographed; to recognize a mark commonly acquired over a first image and a second image that are temporally adjacent, with reference to the acquired information on the at least one mark (e.g., a number, position, direction, shape, and the like of the at least one mark); to generate a mark sequence including information on the positions, directions, shapes, and the like of the recognized mark in the first and second images; and to measure physical quantities related to spin of the ball with reference to the generated mark sequence.

Further, the simulator 220 according to one embodiment of the invention may function to correct, for each of the plurality of photographed images, a position, direction, shape, and the like of at least one mark detected in each of the plurality of images, with reference to a line of sight in which the photographing device 210 views the ball.

Meanwhile, the simulator 220 according to one embodiment of the invention may communicate with the photographing device 210 and the display device 230, and may include a dedicated processor for virtual golf simulation. The dedicated processor may be provided with a memory means and may have capabilities for numerical operations and graphics processing.

Lastly, the display device 230 according to one embodiment of the invention may function to display a result of the physical quantity measurement or virtual reality implementation of the simulator 220. The display device 230 may display images via a display means and, for example, may comprise a screen, which absorbs the impact of the hit golf ball and does not emit light directly, and a projector to output images on the screen.

Hereinafter, it will be discussed how physical quantities related to spin of a golf ball hit by a user are measured using the above-described virtual golf simulation system 200.

First, when a golf ball is hit by a user on the shot unit 10 according to one embodiment of the invention, the photographing device 210 may acquire a plurality of images containing the hit golf ball.

Next, the simulator 220 according to one embodiment of the invention may acquire information on a mark appearing in a region corresponding to the golf ball in each of the plurality of images.

Next, the simulator 220 according to one embodiment of the invention may determine whether it is possible to directly calculate physical quantities related to spin of the golf ball on the basis of the acquired information on the mark.

Next, when it is determined that it is not possible to directly calculate the physical quantities related to spin of the golf ball on the basis of the acquired information on the mark, the simulator 220 according to one embodiment of the invention may estimate the physical quantities related to spin of the golf ball on the basis of physical quantities related to at least one of a speed and an angle of the golf ball or a club hitting the golf ball.

Next, the simulator 220 according to one embodiment of the invention may calculate movement of the golf ball (e.g., a spin rate, a spin direction, a moving speed, a moving direction, an angle of departure, etc.) in virtual reality, on the basis of a variety of physical quantities including the above physical quantities related to spin of the golf ball, and may reflect the calculated movement of the golf ball in a graphical object or transmit a control signal containing a video signal to the display device 230, so that the movement of the golf ball may be realistically displayed in the display device 230.

Meanwhile, the simulator 220 according to one embodiment of the invention may cause images actually photographed by the photographing device 210 or graphical elements for facilitating the user's understanding (e.g., a guide line for indicating a mark sequence, a spin axis, or the like) to be displayed in the display device 230.

Meanwhile, even when it is determined that it is possible to calculate the physical quantities related to spin of the golf ball on the basis of the acquired information on the mark, the simulator 220 according to one embodiment of the invention may determine the physical quantities related to spin of the golf ball by using a first physical quantity related to spin of the golf ball, which is estimated on the basis of the physical quantities related to at least one of a speed and an angle of the golf ball or the club hitting the golf ball, to correct a second physical quantity related to spin of the golf ball, which is calculated on the basis of the acquired information on the mark.

For example, according to one embodiment of the invention, when the movement of the golf ball in virtual reality is calculated only with the second physical quantity related to spin of the golf ball, which is calculated on the basis of the acquired information on the mark, an error may occur in the moving direction of the golf ball in virtual reality due to wrong or failed recognition of the mark (310). However, the error in the moving direction of the golf ball in virtual reality may be corrected by correcting the above second physical quantity using the first physical quantity related to spin of the golf ball, which is estimated on the basis of the physical quantities related to at least one of a speed and an angle of the golf ball or the club hitting the golf ball (320).

The embodiments according to the invention as described above may be implemented in the form of program instructions that can be executed by various computer components, and may be stored on a computer-readable recording medium. The computer-readable recording medium may include program instructions, data files, and data structures, separately or in combination. The program instructions stored on the computer-readable recording medium may be specially designed and configured for the present invention, or may also be known and available to those skilled in the computer software field. Examples of the computer-readable recording medium include the following: magnetic media such as hard disks, floppy disks and magnetic tapes; optical media such as compact disk-read only memory (CD-ROM) and digital versatile disks (DVDs); magneto-optical media such as floptical disks; and hardware devices such as read-only memory (ROM), random access memory (RAM) and flash memory, which are specially configured to store and execute program instructions. Examples of the program instructions include not only machine language codes created by a compiler, but also high-level language codes that can be executed by a computer using an interpreter. The above hardware devices may be changed to one or more software modules to perform the processes of the present invention, and vice versa.

Although the present invention has been described above in terms of specific items such as detailed elements as well as the limited embodiments and the drawings, they are only provided to help more general understanding of the invention, and the present invention is not limited to the above embodiments. It will be appreciated by those skilled in the art to which the present invention pertains that various modifications and changes may be made from the above description.

Therefore, the spirit of the present invention shall not be limited to the above-described embodiments, and the entire scope of the appended claims and their equivalents will fall within the scope and spirit of the invention.

What is claimed is:

1. A method performed in a system for measuring ball spin, the system comprising a simulator including a photographing device and a processor, and the method comprising the steps of:

by the photographing device, photographing a plurality of images of a ball hit by a user;

by the processor, acquiring information on a mark appearing in a region corresponding to the ball hit by the user in each of the plurality of images in which the ball is photographed;

by the processor, determining whether it is possible to directly calculate physical quantities related to spin of the ball on the basis of the information on the mark;

by the processor, in response to determining that it is not possible to directly calculate the physical quantities related to spin of the ball on the basis of the information on the mark, estimating the physical quantities related to spin of the ball on the basis of physical quantities related to at least one of a speed and an angle of the ball or a club hitting the ball; and by the processor, in response to determining that it is possible to calculate the physical quantities related to spin of the ball on the basis of the information on the mark, determining the physical quantities related to spin of the ball by using a first physical quantity related to spin of the ball, which is estimated on the basis of the physical quantities related to at least one of a speed and an angle of the ball or the club hitting the ball, to correct a second physical quantity related to spin of the ball, which is calculated on the basis of the information on the mark.

2. The method of claim 1, wherein in the determining step, when the plurality of images include less than a predetermined number of images in which the mark is detected, it is determined that it is not possible to directly calculate the physical quantities related to spin of the ball.

3. The method of claim 1, wherein in the determining step, when a mark or pattern for measuring the physical quantities related to spin of the ball from the information on the mark is not detected, or a mark or pattern matched to a predetermined mark or pattern does not appear, it is determined that it is not possible to directly calculate the physical quantities related to spin of the ball.

4. The method of claim 1, wherein in the estimating step, the physical quantities related to spin of the ball are estimated with reference to a relationship between physical quantities related to at least one of speeds and angles of a plurality of different balls or a club hitting the plurality of different balls, and physical quantities related to spin of the plurality of different balls.

5. A non-transitory computer-readable recording medium having stored thereon a computer program for executing the method of claim 1.

6. A system for measuring ball spin, the system comprising a simulator including:

a photographing device configured to photograph a plurality of images of a ball hit by a user; and a processor programmed to:

acquire information on a mark appearing in a region corresponding to the ball hit by the user in each of the plurality of images in which the ball is photographed;

determine whether it is possible to directly calculate physical quantities related to spin of the ball on the basis of the information on the mark;

in response to determining that it is not possible to directly calculate the physical quantities related to spin of the ball on the basis of the information on the mark, estimate the physical quantities related to spin of the ball on the basis of physical quantities related to at least one of a speed and an angle of the ball or a club hitting the ball; and in response to determining that it is possible to calculate the physical quantities related to spin of the ball on the basis of the information on the mark, determine the physical quantities related to spin of the ball by using a first physical quantity related to spin of the ball, which is estimated on the basis of the physical quantities related to at least one of a speed and an angle of the ball or the club hitting the ball, to correct a second physical quantity related to spin of the ball, which is calculated on the basis of the information on the mark.

7. The method of claim 1, wherein the system further comprises a display device, and the method further comprises the step of:

by the display device, displaying a movement of the ball on the basis of the physical quantities.

* * * * *